US006374802B1

(12) United States Patent
Boecking

(10) Patent No.: US 6,374,802 B1
(45) Date of Patent: Apr. 23, 2002

(54) FUEL INJECTION SYSTEM

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/623,355

(22) PCT Filed: Nov. 18, 1999

(86) PCT No.: PCT/DE99/03661

§ 371 Date: Dec. 26, 2000

§ 102(e) Date: Dec. 26, 2000

(87) PCT Pub. No.: WO00/39452

PCT Pub. Date: Jul. 6, 2000

(30) Foreign Application Priority Data

Dec. 28, 1998 (DE) ..... 198 60 476

(51) Int. Cl.[7] ..... F02M 37/04
(52) U.S. Cl. ..... 123/446; 123/467; 123/198 DB
(58) Field of Search ..... 123/198 D, 198 DB, 123/497, 446, 467; 137/494, 517

(56) References Cited

U.S. PATENT DOCUMENTS 3,481,542 A * 12/1969 Huber
3,780,716 A * 12/1973 Fenne
5,433,182 A * 7/1995 Augustine ..... 123/456
5,511,528 A * 4/1996 Iwanaga et al. ..... 123/467
5,577,479 A * 11/1996 Popp ..... 123/458
5,868,111 A * 2/1999 Augustin ..... 123/198 D
5,954,032 A * 9/1999 Augustine et al. ..... 123/456
6,192,854 B1 * 2/2001 Polach ..... 123/198 DB

* cited by examiner

*Primary Examiner*—Thomas N. Moulis
(74) *Attorney, Agent, or Firm*—Ronald E. Greigg

(57) ABSTRACT

A fuel injection system for an internal combustion engine with at least one cylinder has an injection unit for each cylinder and a through flow limiting valve for each injection unit, which shuts off the supply of fuel to an injection nozzle contained in the injection unit when the fuel flowing out of the through flow limiting valve reaches a maximal fuel quantity. In order to reduce the maximal fuel quantity, the through flow limiting valve is disposed in a nozzle supply line whereby the injection nozzle communicates with a high-pressure fuel supply.

8 Claims, 2 Drawing Sheets

FUEL INJECTION SYSTEM

BACKGROUND OF THE INVENTION

1. Field of the Invention

The invention relates to a fuel injection system for an internal combustion engine that has at least one cylinder.

2. Description of the Prior Art

A fuel injection system for multicylinder internal combustion engines in which an injection unit is associated with each cylinder and is supplied with fuel at a relatively high pressure from a high-pressure fuel supply is disclosed in DE 44 14 242 A1. In this prior art system, a through flow limiting valve is disposed upstream of the injection unit in the high-pressure fuel supply and closes when the fuel flowing out of the through flow limiting valve reaches a maximal fuel quantity. This is intended to prevent damage to the engine due to a leak in the injection unit.

DE 197 09 794 A1 describes an injection unit in detail, in which an injection valve is supported in axially mobile fashion, which has a valve needle and a piston that is drive-connected to this valve needle, where the valve needle is disposed between an injection nozzle, which feeds into the combustion chamber of the cylinder, and a nozzle supply line, which communicates with the high-pressure fuel supply, and where, at an end remote from the valve needle, the piston protrudes with a closing surface area into a closing pressure chamber and at an end oriented toward the valve needle, protrudes with an opening surface area into an opening pressure chamber. While the closing pressure chamber communicates with the high-pressure fuel supply via a throttle, the opening pressure chamber is connected so that it communicates in an unthrottled manner with the high-pressure fuel supply. Furthermore, a control valve is disposed between the closing pressure chamber and a relief chamber in which a relatively low pressure prevails. The closing surface area is selected to be greater than the opening surface area. When the control valve is closed, the same (high) pressure prevails in the opening pressure chamber as in the closing pressure chamber so that due to the above-mentioned area difference, a resulting force is exerted on the piston, which drives the injection valve into its closed position. As soon as the control valve is opened, for example by means of an electrically actuated Piezoelectric actuator, the closing pressure chamber and the relief chamber are connected to each other in a communicating fashion so that a pressure drop occurs in the closing pressure chamber. Since the pressure in the opening pressure chamber remains at the same level, a resulting force acts on the piston and drives the injection valve into its open position. In order to open the injection valve, the valve needle is pulled out of a valve seat embodied in the injection nozzle so that the fuel can be injected into the combustion chamber at a high pressure.

Since in the known fuel injection systems, the through flow limiting valve is disposed in the high-pressure fuel supply upstream of the injection unit, the maximal fuel quantity defined in the through flow limiting valve must be selected so that it includes the following partial fuel quantities: the maximal injection quantity that is required for the engine in order to be able to produce its maximal power in all operating states. Another partial fuel quantity arises from the control quantity that is required in order to be able to carry out the pressure relief of the closing pressure chamber, in which fuel flows into the relief chamber, for the purpose of opening the injection valve. Finally, the still tolerable leakage quantity for the respective injection unit, which is in particular composed of leaks in the injection valve and in the control valve, must be taken into account as an additional partial fuel quantity. This relatively high maximal fuel quantity must be reached so that a malfunction of the injection unit, for example a valve that is blocked in its open position, or a no longer tolerable leakage, results in the fact that the through flow limiting valve closes the fuel supply to the injection unit. Smaller leaks can consequently lead to a reaction of the through flow limiting valve only in those operating ranges of the engine in which a relatively large injection quantity is required.

SUMMARY OF THE INVENTION

The fuel injection system according to the invention, has the advantage over the prior art that the maximal fuel quantity can be reduced so that the through flow limiting valve reacts earlier, which better protects the engine from damage.

In the fuel injection system according to the invention, the maximal fuel quantity can be reduced since the through flow limiting valve is disposed in the nozzle supply line and consequently operates independent of leaks in the control valve. Correspondingly, the maximal fuel quantity in the fuel injection system according to the invention can be reduced by the relatively large control quantity and by the leakage quantity that is tolerable for the control valve. Accordingly, the new maximal fuel quantity is only slightly greater, namely by the leakage quantity that is tolerable for the injection valve, than the maximally required injection quantity.

BRIEF DESCRIPTION OF THE DRAWINGS

Other advantages and advantageous embodiments of the fuel injection system according to the invention will be apparent from the detailed description contained herein below, taken with the drawings in which.

DESCRIPTION OF PREFERRED EMBODIMENTS

Fuel injection systems according to the invention are usually used in internal combustion engines with a number of cylinders, where each of these cylinders is associated with an injection unit.

Figure 1:
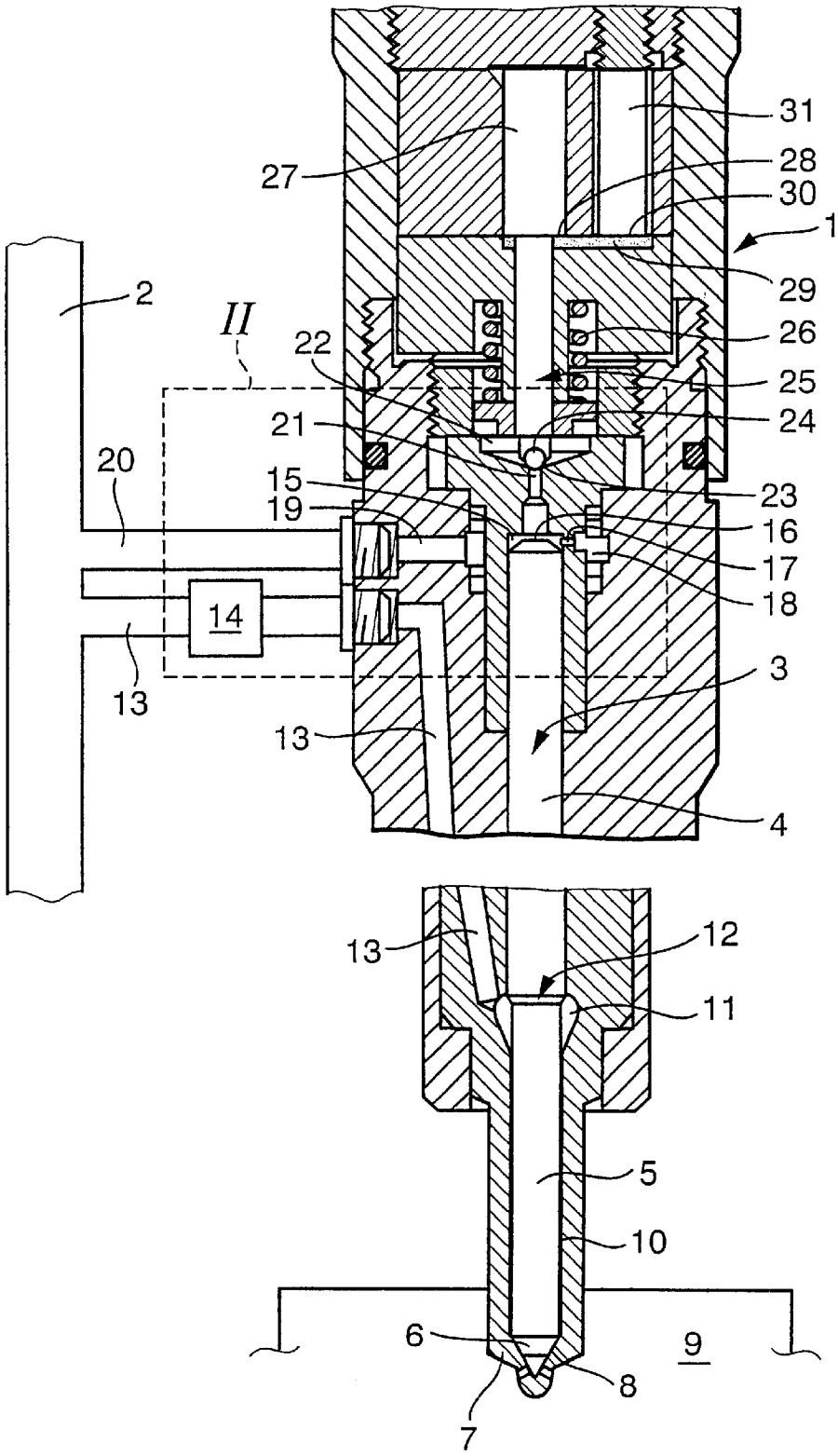
FIG. 1 is a schematic sectional depiction of an injection unit of the fuel injection system according to the invention.

According to FIG. 1, a high-pressure fuel supply 2 supplies an injection unit 1 of this kind with fuel at a relatively high pressure, namely the injection pressure.

The injection unit 1 contains a rod-shaped injection valve 3, which is supported so that it can move axially in the injection unit 1. The injection valve 3 is comprised of a cylindrical piston 4, an axial end of which is drive-connected to a valve needle 5. On its axial free end, this valve needle 5 has a conical needle tip 6, which cooperates with a needle valve seat 8 embodied in an injection nozzle 7. The injection nozzle 7 protrudes into a combustion chamber 9, which is only schematically depicted, of the cylinder associated with the injection unit 1.

Between the valve needle 5 and the region of the injection unit 1, in which the valve needle 5 is guided, a radial, sleeve-shaped annular gap 10 is formed, which at the transition of the valve needle 5 into the piston 4, feeds into an annular opening pressure chamber 11. The axial end of the piston 4 oriented toward the valve needle 5 protrudes into this opening pressure chamber 11; due to the difference in diameter between the piston 4 and the valve needle 5, an opening surface area 12 is produced which is subjected to the pressure prevailing in the opening pressure chamber 11. The opening pressure chamber 11 communicates with the high-pressure fuel supply 2 via a nozzle supply line 13. A through flow limiting valve 14 that is described in more detail below is disposed in this nozzle supply line 13. By means of the communicating connection between the opening pressure chamber 11 and high-pressure fuel supply 2, the high pressure or the injection pressure of the fuel prevails in the opening pressure chamber 11.

On the axial end of the piston 4 remote from the valve needle 5, a closing pressure chamber 15 is embodied in the injection unit 1 and the piston 4, with its axial end face, protrudes into this closing pressure chamber 15 and constitutes a closing surface area 16 there, which is subjected to the pressure prevailing in the closing pressure chamber 15. By way of a throttle 17, the closing pressure chamber 15 communicates with an annular chamber 18 embodied in the injection unit 1 and this annular chamber 18 is in turn connected so that communicates with the high-pressure fuel supply 2 by means of a bore 19 and a line 20. As a result, the same high pressure or injection pressure of the fuel can prevail in the closing pressure chamber 15 as in the opening pressure chamber 11. But since the closing surface area 16 is greater than the opening surface area 12, this produces a downward acting resultant force, which drives the needle tip 6 into the needle valve seat 8.

By means of a relief bore 21, the closing pressure chamber 15 communicates with a relief chamber 22 in which a relatively low pressure prevails, for example the ambient pressure. A valve seat 23 is embodied in the relief chamber 22 and cooperates with a valve body 24 of a control valve 25 that is supported so that it can move axially in the injection unit 1 in order to open and close the relief bore 21. The valve body 24 is prestressed into its closed position, i.e. into the valve seat 23, by means of a helical compression spring 26. The valve body 24 is drive-connected to a control piston 27 which, on an end oriented toward the valve body 24, has a pressure shoulder 28 that protrudes into a pressure chamber 29 and is consequently subjected to the pressure prevailing in this pressure chamber. A pressure surface area 30 of an electrically actuatable piezoelectric actuator 31 also protrudes into this pressure chamber 29.

The injection unit 1 functions as follows:

In a rest position of the injection unit 1, the piezoelectric actuator 31 is deactivated so that the helical compression spring 26 prestresses the valve body 24 into its closed position. As a result, the relief chamber 22 is closed off from the closing pressure chamber 15 so that the injection pressure can build up in the closing pressure chamber 15 by means of the throttle 17. When the injection pressure prevails in the closing pressure chamber 15, the closing force that is produced against the closing surface area 16 is greater than the opening pressure force produced against the opening surface area 12 in the opening pressure chamber 11. The injection valve 3 is then closed.

When an injection is to occur, the piezoelectric actuator 31 is electrically activated which causes it to expand so that its pressure surface area 30 pushes into the pressure chamber 29 and displaces a transmission fluid contained in this chamber. Correspondingly, a force is produced against the pressure shoulder 28 of the control piston 27 and moves the control piston 27 and consequently the control valve 25 in the opening direction. As soon as the valve body 24 opens the connection between the relief chamber 22 and the closing pressure chamber 15, the pressure in the closing pressure chamber 15 drops since less fuel can flow in via the throttle 17 than flows out via the relief bore 21. As a result, a pressure drop occurs in the closing pressure chamber 15 while the pressure in the opening pressure chamber 11 remains constant. Therefore, the opening force acting on the piston 4 becomes greater than the closing force and the needle tip 6 lifts up from the needle valve seat 8. The fuel supplied via the annular gap 10 of the injection nozzle 7 can then be injected into the combustion chamber 9 at the injection pressure.

In order to end the injection event, the piezoelectric actuator 31 is deactivated again so that the control valve 25 is closed again by the spring 26. By means of the throttle 17, the injection pressure can build up again relatively quickly in the closing pressure chamber 15 so that the closing force once again becomes greater than the opening force and the injection valve 3 closes.

For the case in which a leak occurs in the injection valve 3, the fuel quantity which can enter the injection chamber 9 by means of the injection nozzle 7 is limited by means of a maximal fuel quantity defined in the through flow limiting valve 14. Tolerable leakages in the control valve 25 and the control quantity required to control the injection valve 3 can be ignored when determining this maximal fuel quantity. In this connection, the control quantity is the fuel quantity which escapes from the closing pressure chamber 15 into the relief chamber 22 when the control valve 25 is open; fuel continuously flows into the closing pressure chamber by means of the throttle 17.

Figure 2:
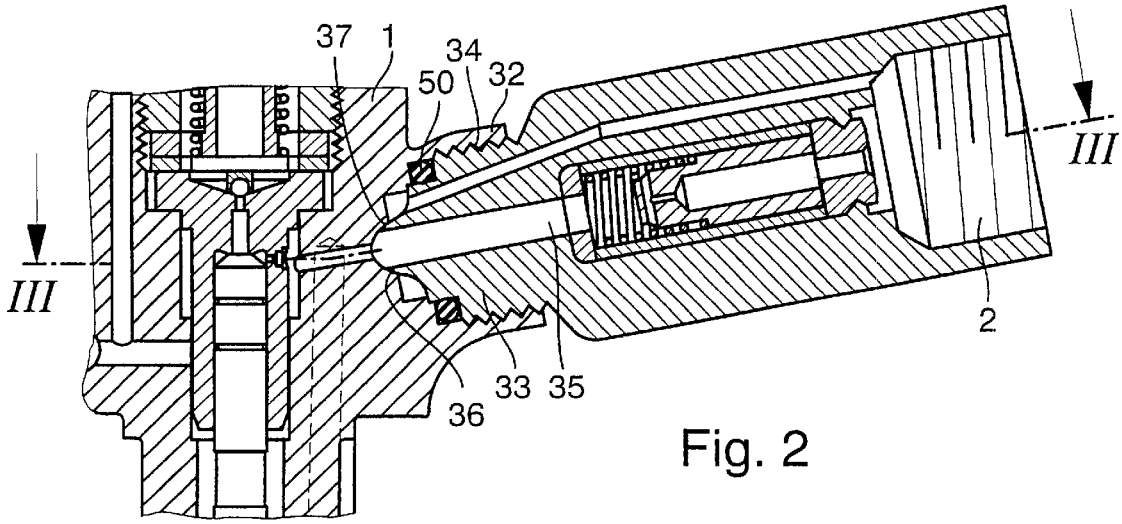
FIG. 2 shows a schematic section through a detail labeled with II in FIG. 1, in another embodiment.
Figure 3:
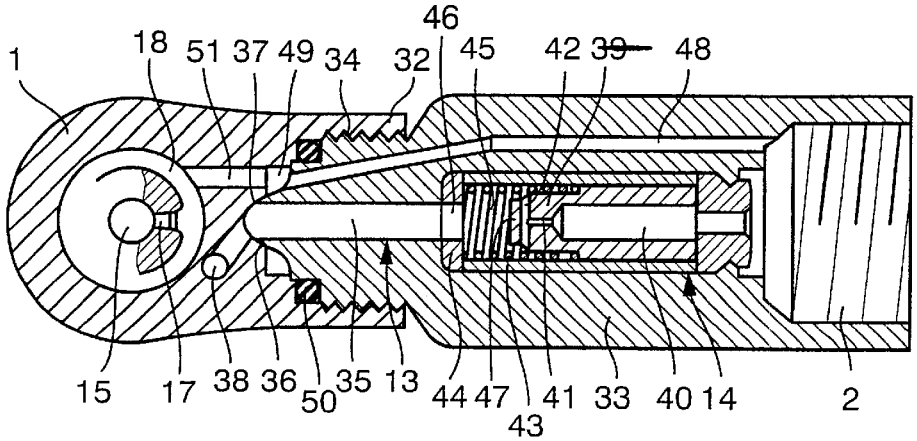
FIG. 3 is a schematic side view of the detail from FIG. 2, in accordance with the cutting line III in FIG. 2.

According to FIGS. 2 and 3, a connection receptacle 32 is embodied in the injection unit 1 and has a connection fitting 33 inserted into it in order to connect the injection unit 1 to the high-pressure fuel supply 2. In the connection receptacle 32 and on the connection fitting 33, a thread 34 is provided, which permits a high-strength connection between the receptacle 32 and the fitting 33.

The connection fitting 33 contains a coaxial first fuel conduit 35, which feeds into a sealing cone 36 at the axial end of the connection fitting 33. When the fitting 33 is inserted into the receptacle 32, the sealing cone 36 presses in a sealed fashion into a complementary sealing seat 37 embodied in the receptacle 32. This sealing seat 32 is connected to a first fuel line 38 which communicates with the nozzle 7 (see FIG. 1). The first fuel line 38 and the first fuel conduit 35 thus constitute the nozzle supply line 13 from FIG. 1.

The through flow limiting valve 14 is disposed in the connection fitting 33 in the first fuel conduit 35. This through flow limiting valve 14 is of a conventional design and contains an axially movable piston 39 which has an inlet opening 40 and outlet opening 42 connected to this inlet opening by means of a throttle location 41. The piston 39 is prestressed in the upstream direction by means of a helical compression spring 43. Between the piston 39 and a stop plate 44 disposed downstream of it, there is a feed chamber 45, whose volume essentially defines the maximal fuel quantity. The feed chamber 45 communicates with the adjacent part of the first fuel conduit 35 downstream by means of an outlet opening 46.

When the injection valve 3 is open, fuel can travel from the nozzle supply line 13 into the combustion chamber 9 so that a pressure drop occurs in the first fuel line 38, which propagates via the first fuel conduit 35, the outlet opening 46, the feed chamber 45, and the outlet opening 42, until it reaches the throttle location 41. At this throttle location 41, this pressure drop results in the fact that a higher pressure prevails upstream of the throttle location 41 than downstream of it so that the piston 39 is moved downstream counter to the spring force of the helical compression spring 43. In the event of a no longer tolerable leakage or a malfunction of the injection unit 1 (for example, the injection valve 3 is jammed in its open position due to an impurity), the feed chamber 45 is emptied until an end plate 47 of the piston 39 comes into contact with the stop plate 44 and thus closes the outlet opening 46 in a sealed fashion. Then a further escape of fuel from the injection nozzle 7 can no longer occur. The piston 39 of the through flow limiting valve 14 can then move upstream, back into its initial position only if a pressure prevails in the outlet opening 46 which is sufficient to lift the end plate 47 up from the stop plate 44. This is typically the case when the injection valve 3 closes properly.

A second fuel conduit 48 is also embodied in the connection fitting 33 and feeds, lateral to the sealing cone 36, into an annular chamber 49 that is embodied in the receptacle 32 between this cone and the fitting 33. This annular chamber 39 is sealed in relation to the outside by means of an annular seal 50. A second fuel line 51 is embodied in the injection unit 1, which communicates with the annular chamber 18 at one end and communicates with the annular chamber 49 at the other end. In the embodiment in FIG. 1, this second fuel line 51 corresponds to the bore 19 and the second fuel conduit 48 corresponds to the line 20. The pressure prevailing in the high-pressure fuel supply 2 propagates via the second fuel conduit 48, the annular chamber 49, the second fuel line 51, the annular chamber 18, and the throttle 17 until it reaches the closing pressure chamber 15.

The foregoing relates to preferred exemplary embodiments of the invention, it being understood that other variants and embodiments thereof are possible within the spirit and scope of the invention, the latter being defined by the appended claims.

I claim:

1. In a fuel injection system for an internal combustion engine that has at least one cylinder, with an injection unit (1) for each cylinder including a high-pressure fuel supply (2), that supplies fuel at a relatively high pressure to the injection unit (1), a nozzle supply line (13) for each injection unit (1), which nozzle supply line connects an injection nozzle (7) of the injection unit (1) so that it communicates with the high-pressure fuel supply (2), and a through flow limiting valve (14) for each injection unit (1), which shuts off the supply of fuel to the injection nozzle (7) when the fuel flowing out of the through flow limiting valve (14) reaches a maximal fuel quantity, the improvement wherein said through flow limiting valve (14) is disposed in the nozzle supply line (13), said injection unit (1) contains a receptacle (32), said high-pressure fuel supply (2) having a connection fitting (33), which can be fastened in the connection receptacle (32), said connection fitting (33) having a first fuel conduit (35) and a second fuel conduit (48), which communicate separately with the high-pressure fuel supply (2), said through flow limiting valve (14) being disposed in the first fuel conduit (35), a first fuel line (38) and a second fuel line (51) being embodied in said connection receptacle (32), said first fuel line (38) communicating with said injection nozzle (7), whereby when the connection fitting (33) is fastened in the connection receptacle (32), the first fuel line (38) is connected so that it communicates with the first fuel conduit (35) and the second fuel line (51) is connected so that it communicates with the second fuel conduit (48), and wherein said the nozzle supply line (13) is constituted by means of the first fuel conduit (35) connected to the first fuel line (38).

2. The fuel injection system according to claim 1, wherein, when said connection fitting (33) is fastened in said connection receptacle (32), an annular chamber (49) is formed between said connection receptacle (32) and said connection fitting (33) and is connected to the one fuel conduit (48) on the one hand and is connected to the associated fuel line (51) on the other.

3. The fuel injection system according to claim 1, wherein said one fuel conduit (35) is disposed coaxially in said connection fitting (33) and feeds into a sealing cone (36), while said associated fuel line (38) feeds into a sealing seat (37) embodied in said connection receptacle (32).

4. The fuel injection system according to claim 1, further comprising an injection valve (3) supported so that it can move axially in the injection unit (1) and has a valve needle (5) and a piston (4) drive-connected to said valve needle, that said valve needle (5) being disposed between the injection nozzle (7), which feeds into a combustion chamber (9) of the cylinder, and the nozzle supply line (13), which communicates with the high-pressure supply line (2), said piston (4), at an end remote from the valve needle (5), protruding with a closing surface area (16) into a closing pressure chamber (15) and, at an end oriented toward the valve needle (5), protrudes with an opening surface area (12) into an opening pressure chamber (11), said opening pressure chamber (11) communicating with the high-pressure fuel supply (2), said closing pressure chamber (15) communicating with the high-pressure fuel supply (2) via a throttle (17), a control valve (25) disposed between said closing pressure chamber (15) and a relief chamber (22) in which a relatively low pressure prevails, said closing surface area (16) being greater than the opening surface area (12) so that when the control valve (25) is closed, the injection valve (3) is driven into its closed position and an opening of the control valve (25) produces a pressure drop in the closing pressure chamber (15) so that the injection valve (3) is driven into its open position.

5. The fuel injection system according to claim 2, wherein said one fuel conduit (35) is disposed coaxially in said connection fitting (33) and feeds into a sealing cone (36), while said associated fuel line (38) feeds into a sealing seat (37) embodied in said connection receptacle (32).

6. The fuel injection system according to claim 1, wherein when said connection fitting (33) is fastened in said connection receptacle (32), an annular chamber (49) is formed between said connection receptacle (32) and said connection fitting (33) and is connected to the one fuel conduit (48) in the one hand and is connected to the associated fuel line (51) on the other, and wherein said one fuel conduit (35) is disposed coaxially in said connection fitting (33) and feeds into a sealing seat (37) embodied in said connection receptacle (32), said sealing cone (36) passing coaxially through said annular chamber (49).

7. The fuel injection system according to claim 6, further comprising an injection valve (3) supported so that it can move axially in the injection unit (1) and has a valve needle (5) and a piston (4) drive-connected to said valve needle, that said valve needle (5) being disposed between the injection nozzle (7), which feeds into a combustion chamber (9) of the cylinder, and the nozzle supply line (13), which communicates with the high-pressure supply line (2), said piston (4), at an end remote from the valve needle (5), protruding with a closing surface area (16) into a closing pressure chamber (15) and, at an end oriented toward the valve needle (5), protrudes with an opening surface area (12) into an opening pressure chamber (11), said opening pressure chamber (11) communicating with the high-pressure fuel supply (2), said closing pressure chamber (15) communicating with the high-pressure fuel supply (2) via a throttle (17), a control valve (25) disposed between said closing pressure chamber (15) and a relief chamber (22) in which a relatively low pressure prevails, said closing surface area (16) being greater than the opening surface area (12) so that when the control valve (25) is closed, the injection valve (3) is driven into its closed position and an opening of the control valve (25) produces a pressure drop in the closing pressure chamber (15) so that the injection valve (3) is driven into its open position.

8. The fuel injection system according to claim 1, further comprising an injection valve (3) supported so that the injection valve (3) can move axially in the injection unit (1) and has a valve needle (5) and a piston (4) drive-connected to said valve needle, that said valve needle (5) being disposed between the injection nozzle (7), which feeds into a combustion chamber (9) of the cylinder, and the nozzle supply line (13), which communicates with the high-pressure supply line (2), said piston (4), at an end remote from the valve needle (5), protruding with a closing surface area (16) into a closing pressure chamber (15) and, at an end oriented toward the valve needle (5), protruding with an opening surface area (12) into an opening pressure chamber (11), said opening pressure chamber (11) communicating with the high-pressure fuel supply (2), said closing pressure chamber (15) communicating with the high-pressure fuel supply (2) via a throttle (17), a control valve (25) disposed between said closing pressure chamber (15) and a relief chamber (22) in which a relatively low pressure prevails, said closing surface area (16) being greater than the opening surface area (12) so that when the control valve (25) is closed, the injection valve (3) is driven into its closed position and an opening of the control valve (25) produces a pressure drop in the closing pressure chamber (15) so that the injection valve (3) is driven into its open position, said second fuel line (51) communicating with said closing pressure chamber (15) by means of said throttle.

* * * * *